United States Patent [19]

Van Heeswijk et al.

[11] Patent Number: 4,943,897

[45] Date of Patent: Jul. 24, 1990

[54] ASSEMBLY OF A LIGHT HOUSING AND AN ELECTRIC LAMP

[75] Inventors: Johannes A. A. M. Van Heeswijk; Henricus M. C. Van Gestel, both of Eindhoven, Netherlands

[73] Assignee: U.S. Philips Corporation, New York, N.Y.

[21] Appl. No.: 377,366

[22] Filed: Jul. 7, 1989

[30] Foreign Application Priority Data

Dec. 23, 1988 [NL] Netherlands ..... 8803150

[51] Int. Cl.[5] ..... F21S 3/00

[52] U.S. Cl. ..... 362/223; 362/217; 362/362

[58] Field of Search ..... 362/217, 223, 263, 362, 362/311

[56] References Cited

U.S. PATENT DOCUMENTS

| | | | |
|---|---|---|---|
| 3,267,275 | 8/1966 | Kendall et al. | 362/217 |
| 3,328,574 | 6/1967 | Linse et al. | 362/217 |
| 3,349,233 | 10/1967 | Angier | 362/220 |
| 3,788,560 | 1/1974 | Hough et al. | 362/217 |
| 4,422,132 | 12/1983 | Trowbridge | 362/362 X |

*Primary Examiner*—Stephen F. Husar

*Attorney, Agent, or Firm*—Robert J. Kraus

[57] ABSTRACT

The assembly comprises a light housing (1) provided with a resilient holding device (7, 7', 8) for an electric lamp (31). The holding device has a first holding member (7, 7') which is bipartite (7, 7'), is rigidly connected to the light housing (1) and has contact regions (9) formed on the limbs of a V. The electric lamp (31) has two lamp caps (40, 41), which have a cylindrically curved surface (42), which is pressed against the contact regions (9) by a second resilient holding member (8). The light source (36) of the lamp (31) is held in a predetermined position in the light housing (1).

30 Claims, 3 Drawing Sheets

ASSEMBLY OF A LIGHT HOUSING AND AN ELECTRIC LAMP

The invention relates to an assembly of a light housing and an electric lamp comprising a light housing provided with walls and a light-emanating window, a resilient holding device for an electric lamp, which holding device has a first holding member with contact regions formed on the limbs of a V and a second holding member facing the first member and cooperating therewith, an electric lamp provided with a lamp vessel having a longitudinal direction and two ends sealed in a vacuum-tight manner, a light source in the lamp vessel extending in the longitudinal direction of the lamp vessel, current supply conductors extending through a respective end of the lamp vessel to the light source, the ends of the lamp vessel being fixed in a first and a second lamp cap, respectively, whose surface is cylindrically curved about an axis extending substantially in the longitudinal direction of the lamp vessel and provided with an electric contact member, to which the current supply conductor is connected.

The invention further relates to a light housing and an electric lamp suitable for use in such an assembly.

Such an assembly is known from GB 838 113 and from "Philips Technische Rundschau", 18, 208–210 (1956/57). This assembly is used to illuminate a monument.

In the known assembly, it is of importance that the beam emanating from the light-emanating window is accurately defined. For this purpose, the known assembly has a shield plate provided with a gap as a second holding member, the lamp vessel being laterally pressed against the boundary of said gap by the first holding member. For this purpose, the first holding member is displaceable against a helical compression spring acting at right angles to the shield plate and engages the wall of the lamp vessel over the major part of its length. Since the monument is elongate in vertical direction and narrow in horizontal direction, the discharge lamp is vertically arranged.

For an accurate positioning of the light source with respect to the light housing, the construction of the known assembly is not intended and not sufficient. The construction positions the lamp vessel, but does not provide a possibility to position accurately the light source, which can have a non-defined position in the lamp vessel. Nevertheless, such an accurate positioning of the light source with respect to the light housing is desirable, especially if said housing comprises optical elements, such as lenses and/or mirrors.

The invention has for its object to provide an assembly of the kind described in the opening paragraph, which has a simple construction holding the light source accurately positioned with respect to references in the light housing. The invention further has for its object to provide a light housing and an electric lamp suitable for use in the assembly.

In an assembly of the kind described in the opening paragraph, according to the invention this object is achieved in that the first holding member is rigidly connected to the light housing and is subdivided, a first part with contact regions formed on the limbs of a V engaging a cylindrically curved surface of a first lamp cap and a second part of similar shape engaging a cylindrically curved surface of the second lamp cap of the electric lamp, the lamp vessel of the electric lamp is fixed with its ends in a respective lamp cap, the light source being aligned with respect to the first holding member, and means are provided, by which rotation of the lamp vessel about its longitudinal direction is limited.

The electric lamp may be an incandescent lamp, for example a halogen incandescent lamp, the light source then being a filament in a halogen gas, which may be arranged in an inner envelope. The lamp may alternatively be a high-pressure discharge lamp, for example a high-pressure mercury discharge lamp, the light source being a pair of electrodes defining a gap arranged in a gas filling containing mercury or mercury and metal halide, the gap extending in the longitudinal direction of the lamp vessel. Such high-pressure mercury discharge lamps have the advantage that they have a high luminance and a high efficiency, while such a lamp with metal halide additions permits of obtaining a satisfactory colour rendition. The light source may be surrounded by an inner envelope within the lamp vessel, for example in order to insulate the discharge thermally more satisfactorily from the environment and hence to bring the metal halide to a higher temperature or to prevent damage of the environment, for example due to UV irradiation or explosion at the end of the life. Especially if the light source has an inner envelope, the positioning of the light source by engagement of the lamp vessel with a holding device would be insufficient. With an eccentric light source and/or a light source obliquely arranged in the lamp vessel, the light source would be correspondingly positioned eccentrically and/or obliquely.

In the assembly according to the invention, the first holding member is rigidly arranged with respect to the light housing. The contact regions of said first holding member consequently have a given predetermined position. During the manufacture of the electric lamp, the lamp caps are held around the ends of the lamp vessel by a holding device similar to that used in the light housing. The light source is then aligned with respect to the first holding member of said holding device, after which the ends of the lamp vessel are fixed in the lamp caps. For this purpose, use may be made, for example, of cement, such as, for example, lamp cement.

When the lamp is arranged in the light housing, the light source occupies the same position with respect to the first holding member, independent of an oblique and/or eccentric position of the light source in the lamp vessel and further independent of variations in the diameter of the lamp caps used. Due to the fact that the first "V-shaped" holding member has a rigid connection with the light housing, the light source occupies a position in the light housing accurately defined in two directions. With the use of the construction of the known device, in which the first "V-shaped" holding member is displaceable under spring force, the same accuracy cannot be obtained. For a flexible displaceability of the member, said member must in fact have lateral clearance. As a result, the position of the light source would be defined less accurately.

In a favourable embodiment, the position of the lamp in the light housing is defined also in the longitudinal direction of the lamp. For this purpose, the light housing has a fixing member, which cooperates with a lamp cap in the longitudinal direction of the lamp vessel. The fixing member may consist in this case of a tongue or a pin passed into a recess in the lamp cap or of the geometric inverse thereof.

Alternatively, the light housing may have a fixing member for each of the two lamp caps. The fixing member or fixing members and the lamp cap or lamp caps may have a searching construction so that the lamp, when arranged in the light housing, slides in its longitudinal direction to its final position.

The fixing member for defining the position of the lamp in its longitudinal direction may also be used as means for limiting rotation of the lamp vessel about its longitudinal direction.

In case each of the lamp caps cooperates in the longitudinal direction of the lamp vessel with a fixing member, a projection of one lamp cap may laterally engage a vane on the light housing and a tongue on the light housing may laterally engage a face at the other lamp cap transverse to the longitudinal axis of the lamp vessel.

However, it may be recommendable that both lamp caps are of the same shape.

In a favourable embodiment, a fixing member may be rigidly connected to the holding device, for example to a part of the first holding member.

Due to the heat produced by electric lamps during operation, expansion of materials occurs. Both the lamp vessel and the light housing expand. This may lead to slipstick phenomena. In a favourable embodiment, at least a part of the first holding member is displaceable against spring force in the longitudinal direction of the lamp. In a variation, both parts of the first holding member are displaceable in this manner. In a specific variation, in which the parts of the first holding member are connected to a respective wall, these walls each have incisions around the relevant part of the first holding member, as a result of which this member is present at a tongue connected to the wall. Upon heating and cooling of the assembly, said tongue can be elastically deformed. It is favourable if also in this variation the fixing member is rigidly connected to the first holding member. The position of the lamp in its longitudinal direction then remains unchanged upon temperature variations.

The lamp caps of an electric lamp suitable for use in the assembly in a favourable embodiment have a flat pressure surface which is substantially parallel to the axis of the lamp cap. Opposite to the pressure surface, the surface has a cylindrical curvature. The lamp caps are fixed on the lamp vessel in mirror image positions one of the other. The pressure surface can cooperate in the assembly with the second holding member. This member can bring the lamp into the correct position of rotation about its longitudinal direction, while engaging the pressure surface of the cap.

In an embodiment of the lamp, the lamp caps have diametrically opposite to the pressure surface a cam with a reference surface transverse to their axis and the cams are positioned at the mirror image positions one of the other. Such a cam is suitable to cooperate with a fixing member in a light housing for fixing the lamp in its longitudinal direction. In a variation of this embodiment, an obliquely ascending surface extends from the reference surface in such a manner that it moves farther away from the pressure surface, the relative distance of the ascending surfaces then becoming smaller when the reference surfaces are remote from each other and becoming larger when the reference surfaces face each other.

In order to bring the electric lamp, when arranged in the light housing, approximately into its correct position before the first and second holding members have come to cooperation, it is useful when a lamp cap has flat surfaces transverse to the pressure surface which extend from the pressure surface to the area at which the lamp cap is cylindrically curved. The lamp caps then fit into a U-shaped holder in the light housing cooperating with the second holding member.

It may be recommendable if the lamp caps of the lamp are not identical. As a result, it can be prevented that a lamp can be accommodated in the light housing in two positions. With the use of a discharge lamp in a position in which the light source is horizontal, that is to say in which a straight connection line between the electrodes is horizontal, a discharge arc between these electrodes takes an upwardly curved form. Consequently, this discharge arc could arrive at another place in the light housing if the lamp is in a first horizontal position than if the lamp reaches, rotated through 180° in a vertical plane, a second horizontal position. On the other hand, it is useful when the lamp caps can be manufactured by means of one tool. In a favourable embodiment, the first and second lamp caps each have an axially projecting electrical contact member, these contact members are dimensioned differently transverse to the axis of the lamp cap, but the lamp caps are otherwise identical. In case the contact members are cylindrical pins, they may have different diameters. The lamp can then be connected to output terminals of a supply source being arranged in the light housing only in one position.

In a specific embodiment, a light housing suitable for use in an assembly according to the invention, has a sleeve-shaped wall portion, a first end portion provided with the light-emanating window and a second end portion displaceable with respect to the sleeve-shaped wall portion. In this embodiment, the sleeve-shaped portion is provided near the second end portion with incisions to form tongues connected to the sleeve-shaped wall portion, in which a first part and a second part, respectively, of the first holding member with contact regions formed on the limbs of a V for a lamp cap of an electric lamp are present, and the second end portion has a resiliently arranged second holding member. The second holding member may be elastically deformable in the longitudinal direction of the electric lamp to neutralize differences in thermal expansion.

In a variation of this embodiment, the second end portion has U-shaped recesses as a holder for an electric lamp, which are in the closed state of the housing located opposite to the first holding member.

An embodiment of the assembly according to the invention is shown in the drawings. In the drawings:

FIGS. 6–8 show another embodiment of a lamp cap, in which

FIG. 7 is an axial sectional view,

FIG. 6 is an elevation taken on VI in FIG. 7,

Figure 5:
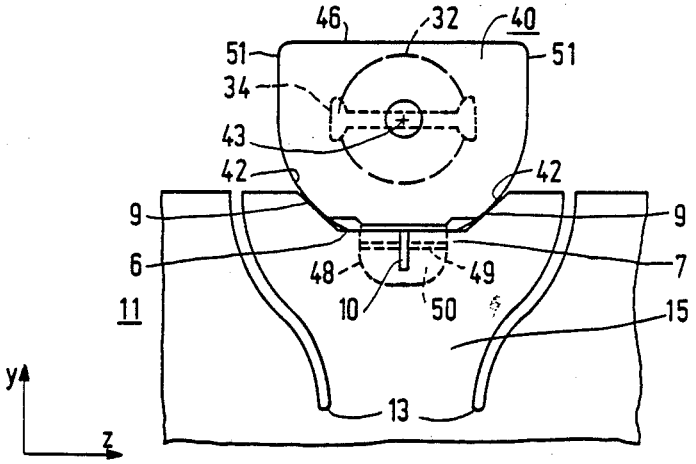
FIG. 5 is a side elevation taken on V in FIG. 4.
Figure 7:
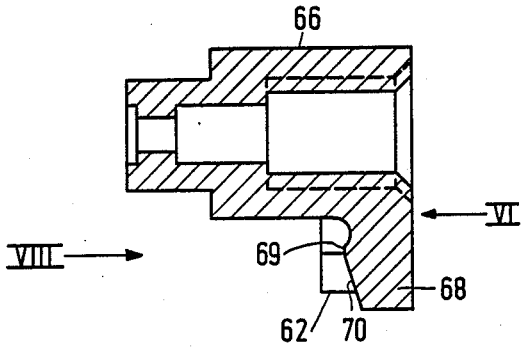
Figure 8:
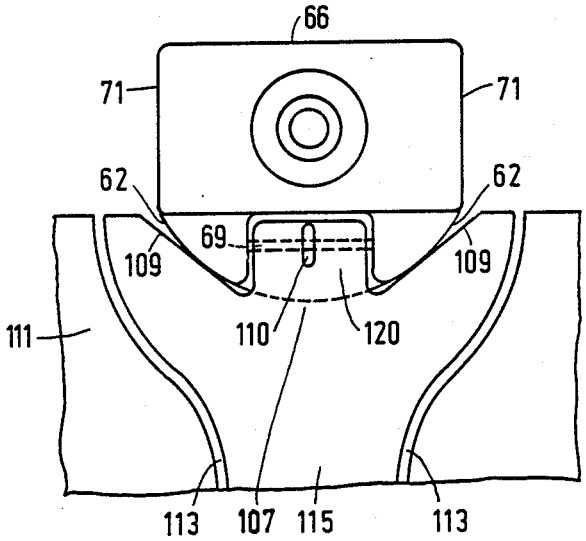

FIG. 8 is an elevation taken on VIII in FIG. 7 of the lamp cap arranged in a holding member analogous to FIG. 5. The assembly of FIG. 1 has a light housing 1 and an electrical lamp 31. The light housing 1 is provided with walls and a light-emanating window. The light housing has a sleeve-shaped wall portion 2, a first end portion 3 provided with the light-emanating window 4 and a second end portion 5 displaceable with respect to the sleeve-shaped wall portion 2. The light housing 1 has a holding device provided with a first holding member 7, 7' with contact regions 9 formed on the limbs of a V and a second holding member 8 (cf. FIG. 2) facing the first holding member 7, 7' and cooperating therewith.

Figure 1:
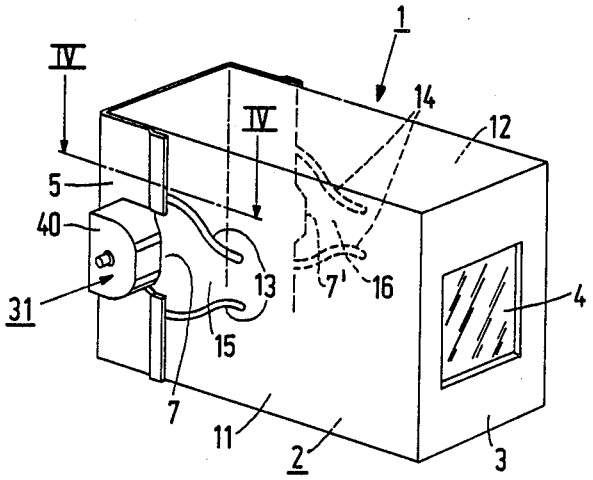
FIG. 1 is a perspective view of an assembly.
Figure 2:
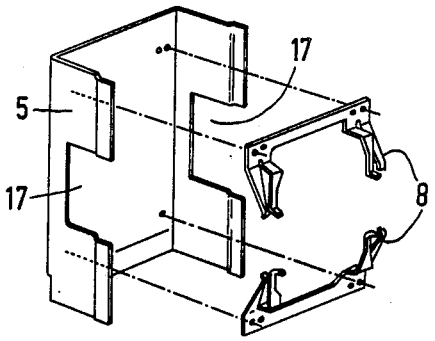
FIG. 2 is a perspective view of part of the assembly shown in FIG. 1.
Figure 3:
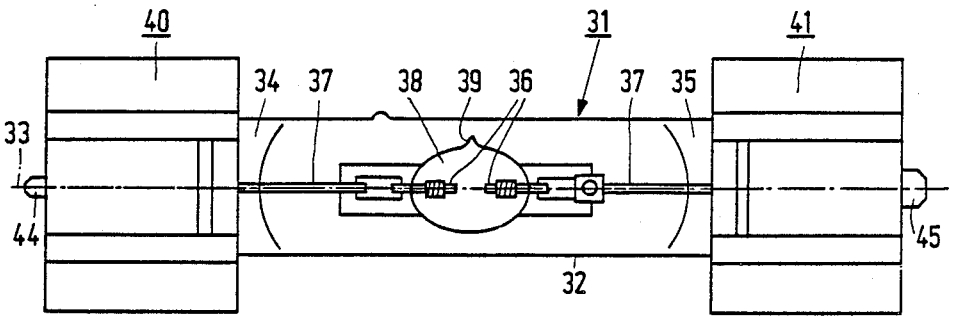
FIG. 3 is a front elevation of the lamp shown in FIG. 1.

The assembly of FIG. 1 has an electric lamp 31 (FIG. 3), which is provided with a lamp vessel 32 having a longitudinal direction 33 and two ends 34, 35, which are sealed in a vacuum-tight manner. A light source 36 in the lamp vessel 32 extends in the longitudinal direction 33 thereof. Current supply conductors 37 extend through a respective end 34, 35 of the lamp vessel 32 to the light source 36. The ends 34, 35 of the lamp vessel 32 are fixed in a first and a second lamp cap 40 and 41, respectively. The light source 36 in this embodiment is a pair of electrodes 36 defining a gap between them, which extends in the longitudinal direction 33 of the lamp vessel 32. The lamp vessel 32 is filled with an ionizable medium of mercury, rare gas and metal halide. The light source 36 is arranged in an inner envelope 38. The sealing tip 39 of an exhaust tube is located in the Figure above the discharge path between the electrodes 36. That is favourable to avoid a comparatively cold spot on the inner envelope 38. The lamp caps 40 and 41 (FIGS. 4 and 5) have a surface 42, which is cylindrically curved about an axis 43 extending substantially in the longitudinal direction 33 of the lamp vessel 32, and are provided with an electrical contact member 44 and 45, respectively, to which a respective current supply conductor 37 is connected.

In the embodiment shown, the first holding member 7, 7' is rigidly connected to the light housing 1 and is subdivided, a first part 7 with contact regions 9 formed on the limbs of a V engaging a cylindrically curved surface 42 of a first lamp cap 40 and a second part 7' of similar shape arranged beside the first part 7 engaging a cylindrically curved surface 42 of the lamp cap 41, which is identical except for the electrical contact member 45. The lamp vessel 32 is fixed by its ends 34, 35 (FIG. 3) in a respective lamp cap 40, 41, the light source 36 being aligned with respect to the first holding member 7,7'. The assembly further has means for limiting rotation of the lamp vessel 32 about its longitudinal direction 33.

Figure 4:
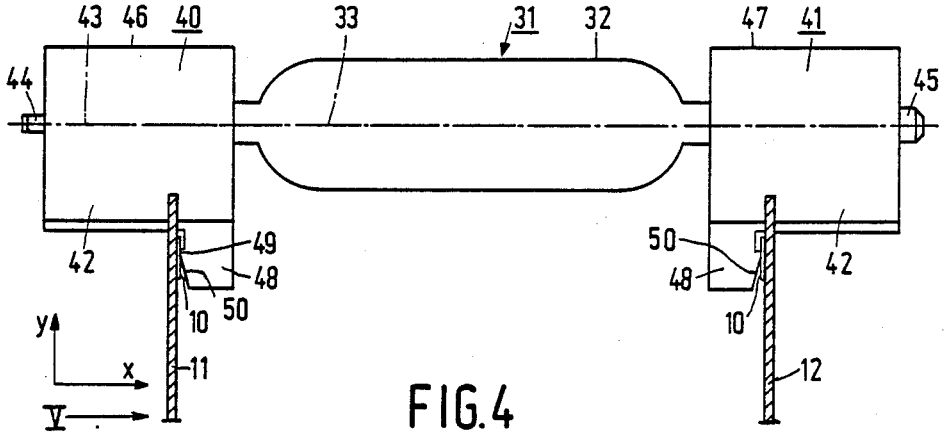
FIG. 4 is a sectional view taken on IV—IV in FIG. 1.

In the closed assembly 1 (FIG. 1), the second holding member 8 presses the lamp 31 with its lamp caps 40, 41 with resilient force against the first holding member 7, 7'. The second holding member is elastically deformable in the longitudinal direction 33 of the lamp 31. Due to the cylindrical surface 42 of the lamp caps and the position of the contact regions 9 of the holding member 7 and 7', respectively, which are both formed on the limbs of a V and rigidly connected to the housing 1 and hence to optical elements of the housing, for example the light-emanating window 4, the lamp caps have a position accurately defined in the y and z direction (FIG. 5) with respect to the housing. Due to the fact that the lamp caps are pressed in the y direction, they are centered in the z direction. Due to the fact that the lamp caps were held in a similar holding device when the ends 34, 35 of the lamp vessel 32 were fixed in said lamp caps 40, 41 and the light source was aligned with respect to said holding device, the light source 36 now occupies a position accurately defined in the y and the z direction. These directions are of major importance in the lamp shown, of which the discharge arc produced by the light source 36 is small in the y and z directions and is comparatively vast in the x direction (FIG. 4). Due to the relative position of the contact regions, lamp caps of deviating size can be used without an inaccurate position of the light source being caused provided that, as is the case in the assembly, the lamp is assembled in a holding member similar to that present in the light housing. Due to the cylindrical surface, the lamp can slide during mounting from a rotated position into the correct position.

In the embodiment shown (FIGS. 4, 5), the light housing 1 has a fixing member 10, which cooperates with each of the lamp caps 40, 41 in the longitudinal direction 33 of the lamp 31. The fixing member 10 is rigidly connected to the holding device, i.e. to the first holding member 7, 7'. In the drawing, the fixing member consists of a narrow depression extending in the y direction on a vane 6 between the contact regions 9 of the first holding member 7, 7'. The fixing member 10 cooperates in the x direction with the lamp 31 and holds the lamp positioned in this direction. The fixing member could define the position of the lamp in the x direction within a margin if it should allow for a certain clearance of the lamp in the x direction. In the embodiment shown, the lamp is accommodated substantially without any clearance. Differences in thermal expansion between the lamp 31 and the light housing 1 could produce stresses. Also if the lamp 31 has clearance in the x direction, the mostly undesired slip-stick phenomenon can nevertheless occur.

In the embodiment shown (FIGS. 1, 5), the first holding member 7, 7' is displaceable against spring force in the longitudinal direction 33 of the lamp 31. The first part 7 and the second part 7' of the first holding member 7, 7' are connected to a respective wall 11, 12 of the light housing. These walls 11, 12 have incisions 13 and 14, respectively, as a result of which respective tongues 15, 16 are present in the relevant wall, which carry the first holding member 7, 7' and the fixing member 10. The tongues 15, 16 are elastically deformed upon temperature variation, as a result of which stresses and slip-stick are avoided. The lamp 31 and the light housing 1 can be dimensioned so that the tongues 15, 16 extend resiliently outwards in the cold state and are located at the operating temperature in the plane of the walls 11 and 12, respectively.

Due to the depression 10, the contact points with the lamp caps 40, 41 are defined more accurately than when the vane 6 should be flat at the area of said depression, especially due to the shape of said lamp caps at the area of the fixing member. Consequently, there are quasi point-shaped 15 contact areas.

The electric lamp 31 (FIGS. 4, 5) has lamp caps 40, 41, which have a flat pressure surface 46, 47, which is substantially parallel to the axis 43 of said lamp cap. The surface 42 of the lamp cap 40 and 41, respectively, has a cylindrical curvature opposite to the pressure surface 46, 47. The lamp caps 40, 41 are arranged at the mirror image places one of the other.

The lamp cap 40 has diametrically opposite to the pressure surface 46 a cam 48 with a reference surface 49 transverse to its axis 43. The cams 48 of the lamp caps are arranged at the mirror image positions one of the other.

An obliquely ascending surface 50 extends from the reference surface 49 whilst moving farther away from the pressure surface 46. The relative distance of the ascending surfaces 50 of the lamp 31 then becomes smaller because they are remote from each other. If these surfaces should face each other, their relative distance would increase with increasing distance from the pressure surface 46. The cams 48 have the shape shown in order to cause the lamp 31 to be searching during its being installed.

The lamp cap 40 as well as the lamp cap 41 have flat surfaces 51 extending transversely to the pressure surface as far as the area at which the lamp cap 40 is cylindrically curved.

In the embodiment of the assembly shown in FIG. 1, the second end portion 5 of the light housing 1 has U-shaped recesses 17 located opposite to the first holding member 7, 7' as a holder for the electric lamp. Due to their shape, the lamp caps 40, 41 have in these recesses 17 a stable position during mounting of the lamp 31 in the light housing 1 and they have a global pre-centering.

The second holding member 8, which cooperates with the flat pressure surface 46, 47 of the lamp cap 40 and 41, respectively, not only ensures the positioning of the light source 36 (FIG. 3) in the y direction and the z direction and by means of the fixing member 10 in the x direction, but also limits the angle through which the lamp, rotated about the axis 33, can be arranged in the light housing 1.

The lamp caps 40 and 41 have an axially projecting electrical contact member 44 and 45, respectively. The transverse dimensions of said members are different, however. Due to this difference, it can be prevented that the lamp 31 can be arranged in the light housing 1 and can be connected to output terminals of a supply source, rotated through 180° in a vertical plane.

Figure 6:
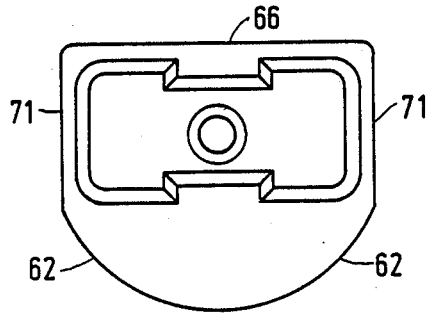

The lamp cap of FIGS. 6–8 has reference numerals which are 20 higher than those of the corresponding parts in FIGS. 4 and 5. In FIG. 8, in which parts of the light housing have reference numerals which are 100 higher than those of corresponding parts in preceding Figures, the first part 107 of a first holding member with contact regions 109 formed on the limbs of a V is shown as part of a tongue 115 on a wall 111 of a light housing. The fixing member 110 is located on a tongue 120 protruding with respect to the contact regions 109. The tongue 120 is narrower at its free end and is consequently searching when installing the lamp with its cap. The tongue 120 limits the possible angular rotation of the lamp cap.

The reference surface 69 is located within the sheath of the cylindrical surface 62.

We claim:

1. An assembly of a light housing and an electric lamp comprising a light housing (1) provided with walls (3, 5, 11, 12) and a light-emanating window (4), a resilient holding device (7, 7', 8) for an electric lamp (31), which holding device has a first holding member (7, 7') with contact regions (9) formed on the limbs of a V and a second holding member (8) facing the first member and cooperating therewith, an electric lamp (31) provided with a lamp vessel (32) having a longitudinal direction (33) and two ends (34, 35) sealed in a vacuum-tight manner, a light source (36) in the lamp vessel extending in the longitudinal direction (33) of the lamp vessel (32), current supply conductors (37) extending through a respective end (34, 35) of the lamp vessel (32) to the light source (36), the ends (34, 35) of the lamp vessel (32) being fixed in a first (40) and a second lamp cap (41), respectively, whose surface is cylindrically curved about an axis (43) extending substantially in the longitudinal direction (33) of the lamp vessel (32) and provided with an electric contact member (44, 45), to which the current supply conductor (37) is connected, characterized in that the first holding member (7, 7') is rigidly connected to the light housing (1) and is subdivided, a first part (7) with contact regions (9) formed on the limbs of a V engaging a cylindrically curved surface (42) of a first lamp cap (40) and a second part (7') of similar shape engaging a cylindrically curved surface (42) of the second lamp cap (41) of the electric lamp (31), the lamp vessel (32) of the electric lamp (31) is fixed with its ends (34, 35) in a respective lamp cap (40, 41), the light source (36) being aligned with respect to the first holding member (7, 7'), and means are provided by which rotation of the lamp vessel (32) about its longitudinal direction is limited.

2. An assembly as claimed in claim 1, characterized in that the light housing (1) has a fixing member (10), which cooperates with the lamp cap (40, 41) in the longitudinal direction (33) of the lamp vessel (32).

3. An assembly as claimed in claim 2, characterized in that the light housing (1) has a fixing member (10), which cooperates with each of the lamp caps (40, 41) in the longitudinal direction (33) of the lamp vessel (32).

4. An assembly as claimed in claim 3, characterized in that the fixing member (10) is rigidly connected to the holding device (7, 7', 8).

5. An assembly as claimed in claim 4, characterized in that the fixing member (10) is rigidly connected to the first holding member (7, 7').

6. An assembly as claimed in claim 5, characterized in that the first holding member (7, 7') displaceable against spring force in the longitudinal direction (33) of the lamp vessel (32).

7. An assembly as claimed in claim 6, characterized in that the first (7) and the second (7') part of the first holding member (7, 7') are connected to a respective wall (11, 12) of the light housing (1) provided with incisions (13, 14) around the relevant part (7 resp. 7') of the first holding member (7, 7'), as a result of which this member is present at a tongue (15, 16) connected to this wall (11, 12).

8. An electric lamp suitable for use in the assembly claimed in claim 1, comprising a lamp vessel (32) having a longitudinal direction (33) and two ends (34, 35), which are sealed in a vacuum-tight manner, a light source (36) in the lamp vessel (32), which extends in the longitudinal direction (33) of the lamp vessel (32), current supply conductors (37), which extend through a respective end (34, 35) of the lamp vessel (32) to the light source (36), the ends (34, 35) of the lamp vessel (32) being fixed in a first (40) and in a second lamp cap (41), respectively, whose surface is cylindrically curved about an axis (43), which extends substantially in the longitudinal direction (33) of the lamp vessel (32) and is provided with an electric contact member (44, 45), to which a respective current supply conductor (37) is connected, characterized in that the lamp caps (40, 41) have a flat pressure surface (46, 47), which is substantially parallel to the axis (43) of the lamp cap (40, 41), the surface (42) of the lamp caps (40, 41) has opposite to the pressure surface (46, 47) a cylindrical curvature and the lamp caps (40, 41) are arranged at the mirror image position one of the other.

9. An electric lamp as claimed in claim 8, characterized in that the lamp caps (40, 41) have diametrically opposite to the pressure surface (46, 47) a cam (48) with a reference surface (49) transverse to their axis (43), which cams (48) are arranged at the mirror image positions one of the other.

10. An electric lamp as claimed in claim 9, characterized in that the reference surface (69) on the cam (68) is located within the sheath of the cylindrical surface (62) of the lamp cap (60).

11. An electric lamp as claimed in claim 10, characterized in that an obliquely ascending surface (50, 70) extends from the reference surface (49, 69), whilst moving farther away from the pressure surface (46, 47, 66), the relative distance of the ascending surfaces (50, 70) becoming smaller when the reference surfaces (49, 69) are remote from each other and becoming larger when the reference surfaces (49, 69) face each other.

12. An electric lamp as claimed in claim 11, characterized in that flat surfaces (51, 71) extend from the pressure surface (46, 47, 66) transversely to the pressure surface (46, 47, 66) as far as the area at which the lamp cap (40, 41, 50) is cylindrically curved.

13. An electric lamp as claimed in claim 12, characterized in that the first (40, 60) and the second lamp cap (41) have an axially projecting electrical contact member (44, 45), which contact members are dimensioned differently transversely to the axis (43) of the lamp caps.

14. A light housing suitable for use in the assembly claimed in claim 1 comprising a housing (1) provided with walls (3, 5, 11, 12) and a light-emanating window (4), a resilient holding device (7, 7', 8) for an electric lamp, which holding device has a first holding member (7, 7') with contact regions (9) formed on the limbs of a V and a second holding member (8) facing the first member and cooperating therewith, characterized in that the first holding member (7, 7') is rigidly connected to the light housing (1) and is subdivided, a first part (7) and a second part (7') being arranged beside each other.

15. A light housing as claimed in claim 14, characterized in that the first holding member (7, 7') is laterally displaceable against spring force.

16. A light housing as claimed in claim 14, characterized in that the first (7) and the second part (7') of the first holding member (7, 7') are connected to a respective wall (11, 12) of the light housing (1) provided with incisions (13, 14) around the relevant part (7, 7'), as a result of which this member is present at a tongue (15, 16) connected to this wall.

17. A light housing as claimed in claim 16, characterized in that a vane (6) is provided between the contact regions (9) of a first part (7) of the holding member (7, 7').

18. A light housing as claimed in claim 16, characterized in that a protruding tongue (120) is present between the contact regions (9) of a first part (7) of the holding member (7, 7').

19. A light housing as claimed in 18, characterized in that the light housing has a sleeve-shaped wall portion (2), a first end portion (3) proVided with a light-emanating window (4) and a second end portion (5) displaceable with respect to the sleeve-shaped wall portion (2), the sleeve-shaped wall portion having the first holding member (7, 7') and the second end portion having the second holding member (8).

20. A light housing as claimed in claim 19, characterized in that the second end portion has opposite to the first holding member (7, 7') recesses (17) in its wall.

21. An assembly as claimed in claim 2, characterized in that the fixing member (10) is rigidly connected to the holding device (7, 7', 8).

22. An assembly as claimed in claim 1, characterized in that the first holding member (7, 7') displaceable against spring force in the longitudinal direction (33) of the lamp vessel (32).

23. An electric lamp as claimed in claim 9, characterized in that an obliquely ascending surface (50,70) extends from the reference surface (49, 69), whilst moving farther away from the pressure surface (46, 47, 66), the relative distance of the ascending surfaces (50, 70) becoming smaller when the reference surfaces (49, 69) are remote from each other and becoming larger when the reference surfaces (49, 69) face each other.

24. A light housing as claimed in claim 15, characterized in that a vane (6) is provided between the contact regions (9) of a first part (7) of the holding member (7, 7').

25. A light housing as claimed in claim 14, characterized in that a vane (6) is provided between the contact regions (9) of a first part (7) of the holding member (7, 7').

26. A light housing as claimed in claim 15, characterized in that a protruding tongue (120) is present between the contact regions (9) of a first part (7) of the holding member (7, 7').

27. A light housing as claimed in claim 26, characterized in that the light housing has a sleeve-shaped wall portion (2), a first end portion (3) provided with a light-emanating window (4) and a second end portion (5) displaceable with respect to the sleeve-shaped wall portion (2), the sleeve-shaped wall portion having the first holding member (7, 7') and the second end portion having the second holding member (8).

28. A light housing as claimed in claim 14, characterized in that a protruding tongue (120) is present between the contact regions (9) of a first part (7) of the holding member (7, 7').

29. A light housing as claimed in claim 28, characterized in that the light housing has a sleeve-shaped wall portion (2), a first end portion (3) provided with a light-emanating window (4) and a second end portion (5) displaceable with respect to the sleeve-shaped wall portion (2), the sleeve-shaped wall portion having the first holding member (7, 7') and the second end portion having the second holding member (8).

30. A light housing as claimed in claim 14, characterized in that the light housing has a sleeve-shaped wall portion (2), a first end portion (3) provided with a light-emanating window (4) and a second end portion (5) displaceable with respect to the sleeve-shaped wall portion (2), the sleeve-shaped wall portion having the first holding member (7, 7') and the second end portion having the second holding member (8).

* * * * *